United States Patent [19]

Clifton

[11] Patent Number: 4,631,220

[45] Date of Patent: Dec. 23, 1986

[54] COATED ABRASIVE BACK-UP PAD WITH METAL REINFORCING PLATE

[75] Inventor: Richard B. Clifton, St. Croix, Wis.

[73] Assignee: Minnesota Mining and Manufacturing Company, Saint Paul, Minn.

[21] Appl. No.: 734,391

[22] Filed: May 14, 1985

[51] Int. Cl.[4] ..... B24D 7/16; B24D 17/00

[52] U.S. Cl. ..... 428/133; 428/64; 428/137; 428/318.4; 51/358; 51/405; 51/401

[58] Field of Search ..... 428/64, 318.4, 137, 428/133; 51/358, 378, 379, 401, 402, 405, 376

[56] References Cited

U.S. PATENT DOCUMENTS 3,510,992 5/1970 Hutchins ..... 51/378

*Primary Examiner*—Alexander S. Thomas

*Attorney, Agent, or Firm*—Donald M. Sell; James A. Smith; William L. Huebsch

[57] ABSTRACT

A coated abrasive back up pad comprising a layer of resiliently compressible foam, a generally rigid fiber reinformced polymeric backing plate, a circular array of openings in the backing plate through which the backing plate is attached by screws to a drive mechanism, and a flexible adhesion layer fixed to an opposite surface of the foam layer and having a generally planar outer support surface adapted to have pressure sensitive adhesive coated abrasive sheets adhered thereto. The back-up pad includes a metal reinforcing plate between the backing plate and the layer of foam which is smaller than the backing plate for insuring that the screws will not break through the backing plate during use of the back-up pad to drive a sheet of coated abrasive, and the adhesion layer is radiused around access holes to the screws from the support surface so that the foam layer will not produce greater grinding pressure in those areas than in adjacent areas.

7 Claims, 3 Drawing Figures

COATED ABRASIVE BACK-UP PAD WITH METAL REINFORCING PLATE

Technical Field

The present invention relates to back-up pads of the type adapted to hold a sheet of coated abrasive material and to be driven by a drive mechanism to abrade a surface with the coated abrasive.

BACKGROUND ART

Coated abrasive back-up pads are known which include a support surface to which sheets having coated abrasive material on one surface and pressure sensitive adhesive on the other may be releasably adhered. Typically the support surface is on a flexible polymeric adhesion layer attached to one surface of a layer of resiliently compressible foam, and the back-up pad has a rigid backing plate attached to an opposite surface of the layer of foam and adapted to be attached to a drive mechanism by a circular array of screws so that the drive mechanism can be used to drive the pad and thereby the abrasive against a surface to be abraded while the layer of foam provides a flexible cushion that causes the abrasive to follow and level the contour of that surface. In one eight inch diameter embodiment of such a back-up pad commercially available from National Detroit, Detroit, Michigan, the backing plate is of aluminum which can bend if the pad is dropped or otherwise impacted edgewise against a solid surface; whereas in another commercially available from Eezer, Fresno, Calif., the backing plate is of a fiber reinforced polymeric material (i.e., fiberglass reinforced epoxy) which can withstand such impacts, but is sufficiently brittle that flexing of the backing plate with the foam layer can cause the screws to break through the backing plate or to break away portions of the backing plate, thereby causing the back-up pad to come loose from the drive mechanism.

Additionally, the screws that attach the backing plate to the drive mechanism are attached or removed through access holes through the adhesion layer and the layer of foam. The portion of the pad around these access holes presents two problems. Removal of numerous sheets of abrasive material from the support surface can pull the edge of the adhesion layer away from the foam and eventually cause portions of it to break away. Also, molding the access holes in the layer of foam causes a foam skin layer around the access opening that is less flexible than adjacent portions of the foam. Thus areas of greater pressure are provided around the access openings when the pad is used to press moving abrasive material against a surface that can result in uneven grinding of a workpiece.

DISCLOSURE OF THE INVENTION

The present invention provides a coated abrasive back-up pad generally of the type describe above but including the combination of a fiber reinforced polymeric backing plate that will not permanently bend when it is impacted edgewise against a solid surface and a metal reinforcing plate that effectively prevents the back-up pad from breaking and coming loose from the drive mechanism, which back-up pad has no areas around its screw access holes that produce greater grinding pressure than the rest of the back-up pad.

The coated abrasive back-up pad according to the present invention, like the second prior art back-up pad described above, comprises a layer of resiliently compressible foam having first and second generally parallel spaced surfaces, the generally rigid fiber reinforced polymeric backing plate (e.g. of fiberglass reinforced epoxy) fixed to the first surface of the layer of foam, and a flexible adhesion layer fixed to the second surface of the layer of foam, which adhesion layer has a generally planar support surface opposite the layer of foam adapted to have pressure sensitive adhesive coated abrasive sheets releasably adhered thereto. The backing plate has a circular concentric array of through openings adapted to receive the shanks of screws for coupling the backing plate to a drive mechanism, and the layer of foam has a corresponding array of aligned larger access openings for receiving the heads of such screws. The back-up pad according to the present invention is improved in that it includes the metal reinforcing plate around the openings between the backing plate and the layer of foam which has through openings for receiving the shanks of the screws aligned with the through openings in the backing plate, and has a support surface that is radiused at its juncture with the access openings so that the skins on the foam layer defining the access openings will not produce areas of higher grinding pressure along the support surface than do adjacent portions of the foam layer.

Preferably the reinforcing plate is of aluminum about 0.762 centimeter (0.03 inch) thick in a direction parallel to the first surface of the foam. Such a reinforcing plate has been found to reliably protect the fiber reinforced polymeric backing plate from breaking around the screws on circular back-up pads of the type used on drive mechanisms or grinders that have both rotary and orbital motion.

The reinforcing plate also serves to provide a desired amount of weight for the pad which is required to produce a desired moment of inertia for the drive mechanism with which it is intended to be used, while placing that weight closer to the axis of rotation to minimize the adverse effect that any excentricity in the pad will have on the drive mechanism. Also, the size (particularly the thickness) of the reinforcing plate may be increased or decreased to respectively compensate for decreasing or increasing the density of the foam so that for a predetermined back-up pad thickness a desired overall weight for the back-up pad may be maintained while the density of the foam is adjusted to provide a desired flexibility in the foam for pressing the abrasive against a surface to be abraded.

Preferably the back-up pad is made by a method comprising providing a mold having a main wall with an inner surface, a generally circular peripheral wall with an inwardly tapered inner surface projecting above the inner surface, and a plurality of spaced pins projecting generally at right angles from the inner surface of the main wall. The pins are disposed in a circular array around the axis of the peripheral wall, and each has a base portion adjacent the bottom wall of a size adapted to produce the access openings and a concentric distal portion of a diameter smaller than the diameter of the base portion adapted to be received in the through openings of the plates. A flexible adhesion layer having pre-formed holes in an array corresponding to that of the pins and with diameters slightly smaller than the base portion of the pins is placed against the inner surface of the main wall with the adhesion layer stretched so that the pins are received in the holes and the adhesion layer around the pins is radiused or curved away from the plane of the inner surface around the pins. The reinforcing and back-up plates which have pre-formed holes in an array corresponding to that of the pins are then placed over the distal portions of the pins. Foam is introduced into the cavity then formed by the plates, the adhesion layer and the peripheral wall, and allowed to cure. The back-up pad can then be removed from the mold.

BRIEF DESCRIPTION OF THE DRAWING

The present invention will further be described with reference to the accompanying drawing wherein like numerals refer to like parts through the several views and wherein.

DETAILED DESCRIPTION OF THE PREFERRED EMBODIMENT

Figure 1:
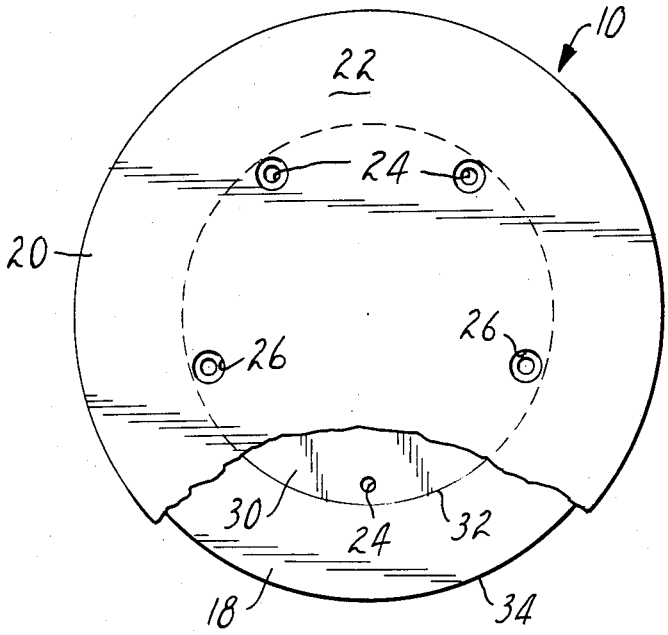
FIG. 1 is a plan view of a coated abrasive back-up pad according to the present invention having parts broken away to show details.
Figure 2:
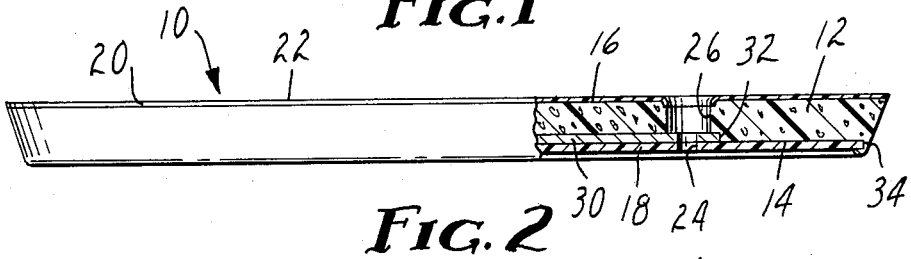
FIG. 2 is an enlarged edge view of the back up pad of FIG. 1 having parts broken away to show details.

Referring now to the drawing there is shown a coated abrasive back-up pad according to the present invention, generally designed by the reference numeral 10.

The coated abrasive back-up pad 10 according to the present invention comprises a layer of resiliently compressible foam 12 (e.g., closed cell polyurethane foam) having first and second generally parallel spaced surfaces 14 and 16, a generally rigid fiber reinforced polymeric (e.g., fiberglass reinforced epoxy) backing plate 18 fixed to the first surface 14 of the layer of foam 12, and a flexible polymeric adhesion layer 20 (e.g., vinyl) fixed to the second surface 16 of the layer of foam 12. The adhesion layer 20 has a generally planar support surface 22 opposite the layer of foam 12 adapted to have pressure sensitive adhesive coated abrasive sheets (not shown) removably adhered thereto. The backing plate 18 has a circular concentric array of through openings 24 adapted to receive the shanks of screws for coupling the backing plate 18 to a drive mechanism (not shown) and the layer of foam 12 and the adhesion layer 20 have a corresponding array of aligned larger access or clearance openings 26 for receiving the heads of such screws.

Unlike prior art back-up pads, the improved back-up pad 10 according to the present invention includes a metal reinforcing plate 30 around the through openings 24 between the backing plate 18 and the layer of foam 12, which reinforcing plate 30 has through openings for receiving the shanks of the screws aligned with the through openings 24 in the backing plate 18, and has a periphery 32 spaced a substantial distance from the periphery 34 of the backing plate 18.

Preferably the metal reinforcing plate 30 is of aluminum and is in the range of about 0.06 to 0.09 (preferably 0.076) centimeter thick in a direction normal to the first surface 14 of the layer of foam 12.

Also, as illustrated the reinforcing plate 30 and the backing plate 18 are both preferably circular and are concentric with each other, with the layer of foam 12 which is in the shape of a conical frustum and with the circular adhesion layer 20, and the periphery 32 of the metal reinforcing plate 30 is spaced inwardly from the periphery of the backing plate 18 by a distance of at least 1.3 centimeters (½ inch) and preferably by about 3.2 centimeter (1¼ inch) or so as to preferably provide about 50 percent of the area of the backing plate 18 around the reinforcing plate 30, and at least about 13 percent of the area of the backing plate 18 around the reinforcing plate 30 that can flex with the layer of foam 12 during use of the back up pad 10.

Figure 3:
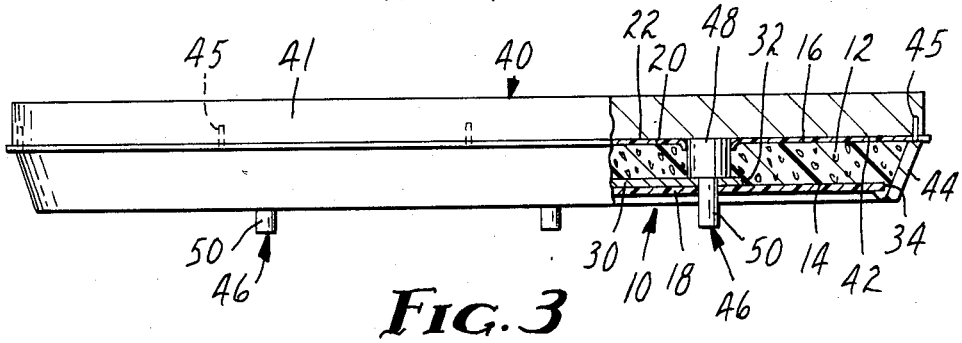
FIG. 3 is an edge view of the back-up pad of FIG. 1 shown in a mold used to form the back-up pad, which pad and mold have parts broken away to show details.

FIG. 3 illustrates a method for forming a back-up pad 10 comprising the steps of providing a mold 40 comprising a main wall 41 having an inner surface 42, a generally circular removable peripheral wall 44 with an inwardly tapered inner surface projecting from the main wall 41 above the inner surface 42 and located with respect to the main wall 41 by a pair of projections 45, and a plurality of spaced pins 46 projecting from the main wall 41 generally normal to its inner surface 24 disposed in a circular array around the axis of the peripheral wall 44. Each pin 46 has a base portion 48 adjacent the main wall 41, which base portion 48 has the same diameter and axial length as the access openings 26 to be formed in the pad 10, and a concentric distal portion 50 of a diameter smaller than the diameter of the base portion 48 and about the same diameter as the through openings 24 formed in the plates 18 and 30. The flexible adhesion layer 20 having pre-formed holes in an array corresponding to that of the pins 46 and with diameters slightly smaller than the diameters of the base portions 48 of the pins 46 (e.g., 0.8 centimeter diameter or 5/16 inch holes in the adhesion layer 20 on 0.95 centimeter or 0.375 inch base portions 48 or 0.15 centimeter or 1/16 inch interference fits) is placed against the inner surface 42 of the main wall 41 with the pins 46 received in its holes so that the adhesion layer 20 around the pins 46 is curved away from the plane of the inner surface 42 by being stretched into engagement around the pins 46 (e.g., curved to produce a radius of at least 0.15 centimeter or 1/16 inch and preferably about 0.3 centimeter or 1/8 inch). The plates 18 and 30 which also have pre-formed holes in an array corresponding to that of the pins are placed over the distal portions 50 of the pins 48 so that the plates 18 and 30 are supported against the base portions 48 of the pins where they join the distal portion 50. Foam is introduced into the cavity then formed between the plates 18 and 30, the adhesion layer 20 and the peripheral wall 44, and is allowed to cure, after which the back-up pad 10 can be removed from the mold 40, and the adhesion layer 20 trimed around the layer of foam 12 to complete the back-up pad 10.

The present invention has now been described with reference to one embodiment thereof. It will be apparent to those skilled in the art that many changes can be made in the embodiment described without department from the scope of the present invention. For example, the reinforcing plate could have an opening in its center, or could be in several segments around the through openings. Also, different fiber reinforced polymeric materials can be used for the backing plate 18. Thus the scope of the present invention should not be limited to the structures described in this application, but only by structures described by the language of the claims and the equivalents of those structures.

I claim:

1. A coated abrasive back-up pad comprising a layer of resiliently compressible foam having first and second generally parallel spaced surfaces; a generally rigid fiber reinforced polymeric backing plate fixed to the first surface of said layer of foam; and a flexible adhesion layer fixed to the second surface of said layer of foam, said adhesion layer having a generally planar support surface opposite said layer of foam adapted to have pressure sensitive adhesive coated abrasive sheets removably adhered thereto; said backing plate having a circular concentric array of through openings adapted to receive the shanks of screws for coupling the backing plate to a drive mechanism and said layer of foam and said adhesion layer having a corresponding array of aligned larger access openings for receiving and accessing the heads of such screws; said back-up pad further including a metal reinforcing plate around said through openings between said backing plate and said layer of foam, said reinforcing plate having through openings for receiving the shanks of the screws aligned with the through openings in said backing plate and having a periphery spaced a substantial distance inwardly from the periphery of said backing plate; and said adhesion layer being curved out of the plane of said support surface toward said backing plate around said access openings to provide radiuses at the junctures of said support surface with said access openings so that the adhesion layer will not be pulled away from the foam layer around the access openings by removal of abrasive sheets, and skins on the foam layer defining the access openings will not produce areas of higher grinding pressure along the support surface than will adjacent portions of the foam layer.

2. A back-up pad according to claim 1 wherein said metal reinforcing plate is in the range of about 0.06 to 0.09 centimeter thick in a direction normal to said first surface.

3. A back-up pad according to claim 1 wherein said layer of foam is in the shape of a conical frustum.

4. A back-up pad according to claim 1 wherein said reinforcing plate and said backing plate are both circular and are concentric, and the periphery of said metal reinforcing plate is spaced inwardly from the periphery of said plastic backing plate by a distance of at least about 1.3 centimeters.

5. A back-up pad according to claim 1 wherein said reinforcing plate and said backing plate are both circular and are concentric, and the periphery of said metal reinforcing plate is spaced inwardly from the periphery of said plastic backing plate by a distance of about 3.2 centimeters.

6. A back-up pad according to claim 1 wherein said support surface has a radius of about 0.3 centimeter at its junctures with said clearance openings.

7. A coated abrasive back-up pad comprising a layer of resiliently compressible foam having first and second generally parallel spaced surfaces; a generally rigid backing plate fixed to the first surface of said layer of foam; and a flexible adhesion layer fixed to the second surface of said layer of foam, said adhesion layer having a generally planar support surface opposite said layer of foam adapted to have pressure sensitive adhesive coated abrasive sheets removably adhered thereto; said backing plate having a circular concentric array of through openings adapted to receive the shanks of screws for coupling the backing plate to a drive mechanism and said layer of foam and said adhesion layer having a corresponding array of aligned larger access openings for receiving and accessing the heads of such screws; and said adhesion layer being curved out of the plane of said support surface toward said backing plate around said access openings to provide radiuses at the junctures of said support surface with said access openings so that the adhesion layer will not be pulled away from the foam layer around the access openings by removal of abrasive sheets, and skins on the foam layer defining the access openings will not produce areas of higher grinding pressure along the support surface than do adjacent portions of the foam layer.

* * * * *